United States Patent [19]

Arimoto

[11] Patent Number: 4,575,599

[45] Date of Patent: Mar. 11, 1986

[54] SPIRAL ARC CIRCUIT BREAKER

[75] Inventor: Satomi Arimoto, Nishinomiya, Japan

[73] Assignee: Mitsubishi Denki Kabushiki Kaisha, Tokyo, Japan

[21] Appl. No.: 618,409

[22] Filed: Jun. 6, 1984

[30] Foreign Application Priority Data

Jun. 30, 1983 [JP] Japan ..... 58-120830

[51] Int. Cl.[4] ..... H01H 9/44; H01H 33/18

[52] U.S. Cl. ..... 200/147 A; 200/147 R

[58] Field of Search ..... 200/147 A, 147 R

[56] References Cited

U.S. PATENT DOCUMENTS 3,082,308 3/1963 Baker ..... 200/147 A 3,892,461 7/1975 Keto ..... 200/147 A

FOREIGN PATENT DOCUMENTS 2254871 7/1975 France ..... 200/147 A

*Primary Examiner*—Robert S. Macon

*Attorney, Agent, or Firm*—Wenderoth, Lind & Ponack

[57] ABSTRACT

A spiral arc circuit breaker is disclosed in which the arc created between breaker electrodes at the time of circuit breaking is confined inside a longitudinally-extending annular gap. Magnetic fluxes having directions perpendicular to the longitudinal axis of the gap are created in the gap by a magnetic drive coil which surrounds the gap, a plurality of first yokes disposed outside of the gap, and a second yoke longitudinally disposed at the center of the circuit breaker. The arc created within the gap and the magnetic flux produced by the drive coil cross at right angles so that the magnetic flux can effectively act on the arc to produce spiraling of the arc within the gap. In contrast to conventional spiral arc circuit breakers, effective spiraling can be achieved even when the separation between the electrodes of the circuit breaker is large.

9 Claims, 9 Drawing Figures

SPIRAL ARC CIRCUIT BREAKER

BACKGROUND OF THE INVENTION

This invention relates to circuit breakers in general, and in particular to an improved spiral arc circuit breaker which produces a more effective arc-extinguishing action and which is of a simpler structure than presently-existing spiral arc circuit breakers.

At present, the most commonly used type of circuit breaker for handling high voltages is the puffer-type circuit breaker in which a cooling gas is forcefully blown by a piston against an arc produced at the time of breaking, thereby extinguishing the arc. The puffer-type circuit breaker has the disadvantage that a driving mechanism is necessary to drive the piston which blows the cooling gas against the arc, and accordingly a small-sized puffer-type circuit breaker can not be achieved.

To overcome this and other disadvantages of the puffer-type circuit breaker, the rotary arc circuit breaker and the spiral arc circuit breaker were developed. In these devices, a magnetic force is applied to the arc produced between open contacts at the time of circuit breaking, causing the arc to either rotate or spiral at a high speed between the open contacts. The motion of the rotating or spiraling arc relative to a stationary cooling medium such as $SF_6$ gas contained within the circuit breaker cools the arc. At the same time, the rotation or spiraling lengthens the arc to the point where the system voltage can no longer sustain the arc, and the arc is thereby extinguished. Since it is not necessary to employ mechanical means to blow the gas against the arc, the structure of a rotary arc or spiral arc circuit breaker is simpler than that of a puffer-type circuit breaker, and a circuit breaker of smaller size is achievable.

FIGS. 1 and 2 show longitudinal cross sections of a conventional rotary arc circuit breaker and a conventional spiral arc circuit breaker, respectively. In the figures, element number 1 is a fixed electrode, element number 2 is a movable electrode which slides into and out of contact with the fixed electrode 1, element number 3 is an arc runner, element number 4 is a magnetic drive coil, element number 5 is an arc which develops between the fixed electrode 1 and the movable electrode 2 when the circuit breaker opens, and element number 6 is an electrically insulating member which protects the movable electrode 2 of the spiral arc circuit breaker in FIG. 2.

The operation of these conventional circuit breakers is briefly as follows. At the time of circuit breaking, the movable electrode 2 is separated from the fixed electrode 1, and an arc 5 carrying a current i develops between the movable electrode 2 and the fixed electrode 1. The arc 5 then shifts from the fixed electrode 1 to the arc runner 3. Both circuit breakers are so designed that the current i also flows through the magnetic drive coil 4, which produces a magnetic flux phi. This flux acts upon the arc 5 and causes the arc to either rotate (in the circuit breaker of FIG. 1) or spiral (in the circuit breaker of FIG. 2) at a high speed between the movable electrode 2 and the arc runner 3. The rotating or spiraling arc 5 is extinguished by the cooling effect of the relative motion between it and a stationary cooling gas such as $SF_6$ contained in the circuit breaker, and by the lengthening of the arc 5 due to rotation or spiraling.

The rotary arc circuit breaker of FIG. 1 has the disadvantage that the flux phi in the vicinity of the movable electrode 2 grows weaker as the distance between the movable electrode 2 and the arc runner 3 increases. When the separation between the two is large, the force produced by the flux phi on the arc 5 in the vicinity of the movable electrode 2 is much weaker than the force acting on the portion of the arc 5 in the vicinity of the arc runner 3. As a result, the force does not produce adequate rotational movement of the arc 5 and adequate cooling and lengthening of the arc 5 can not be achieved.

On the other hand, the spiral arc circuit breaker illustrated in FIG. 2 has the disadvantage that it is difficult to make the arc 5 and the flux phi intersect at right angles. In order for the flux phi produced by the magnetic drive coil 4 to effectively exert force on the arc 5, the directions of the arc 5 and the flux phi should be as nearly perpendicular to one another as possible, since no force acts on the arc 5 when it is parallel to the flux phi. In the spiral arc circuit breaker of FIG. 2, it is necessary for the movable electrode 2 to have an E-shaped cross section so that the direction of the current i flowing through the bottom portion 2*a* of the movable electrode 2 will be opposite to the direction of the current i flowing through the bottom portion 3*a* of the arc runner 3. The magnetic forces produced by these currents i flowing in opposite directions react to cause the arc 5 to bulge outwards towards the magnetic drive coil 4 in its midportion 5*a*, and portions of the arc 5 are thereby able to intersect the flux phi at right angles.

As can be seen from FIG. 3 which shows a view of a portion of the circuit breaker of FIG. 2 when the separation between the movable electrode 2 and the arc runner 3 is small, this bulge in the midportion 5*a* of the arc 5 causes the arc 5 to intersect the flux phi at right angles in the portion 5*b* near the arc runner 3 and in the portion 5*c* near the end of the movable electrode 2, and the arc 5 is caused to spiral. However, when the separation increases to that shown in FIG. 4, the above-described reaction between the current i in the bottom portion 2*a* of the movable electrode 2 and the current i in the bottom portion 3*a* of the arc runner 3 is no longer effective in the vicinity of the arc runner 3. A bulge in the arc 5 resulting from the E-shape of the movable electrode 2 is produced in the vicinity of the movable electrode 2, but in the vicinity of the arc runner 3, the arc 5 is parallel to the flux phi and no force acts upon it. In this case, the arc 5 will not spiral and the desired cooling and lengthening of the arc 5 can not be produced.

The above-described drawbacks of rotary arc and spiral arc circuit breakers have made the development of high voltage, large-capacity circuit breakers of this kind difficult.

SUMMARY OF THE INVENTION

It is the object of the present invention to provide a spiral arc circuit breaker which overcomes the drawbacks of conventional spiral arc circuit breakers and causes an arc produced between breaker electrodes at the time of circuit breaking to spiral at a high speed between the electrodes, even when the electrode separation is large.

It is a further object of the present invention to provide a spiral arc circuit breaker which is of a simpler construction than conventional spiral arc circuit breakers.

In a circuit breaker according to the present invention, the arc produced when breaking action occurs is confined to a longitudinally-extending annular gap between two longitudinally-extending electrically insulating members. A magnetic flux is produced in the gap by a magnetic drive coil surrounding the gap, and the direction of the flux in the gap is caused to be radially inwards or outwards at opposite longitudinal ends of the gap through the use of a plurality of first yokes fitted on the magnetic drive coil and a second yoke embedded inside the inner of the above-mentioned two electrically insulating members. The flux produced by the magnetic drive coil and the arc within the annular gap cross at right angles, regardless of the separation between the electrodes of the circuit breaker. Thus, the flux acts effectively on the arc to cause it to spiral around the inside of the annular gap.

A spiral arc circuit breaker according to the present invention comprises a hollow movable electrode which slides into and out of contact with a fixed electrode, a longitudinally-extending inner electrically insulating member coaxially disposed inside the movable electrode, a longitudinally-extending outer electrically insulating member coaxially disposed outside the inner insulating member so that a longitudinally-extending annular gap is formed between the two, and means for producing a magnetic flux inside the gap, the direction of the flux being radially inwards at one of the longitudinal ends of the gap and radially outwards at the opposite longitudinal end of the gap.

In a preferred embodiment, the means for producing a magnetic flux in the gap comprises a magnetic drive coil which concentrically surrounds the movable electrode, a plurality of first yokes fitted on the magnetic drive coil, and a second yoke located inside the hollow movable electrode.

DESCRIPTION OF THE PREFERRED EMBODIMENT

Figure 5:
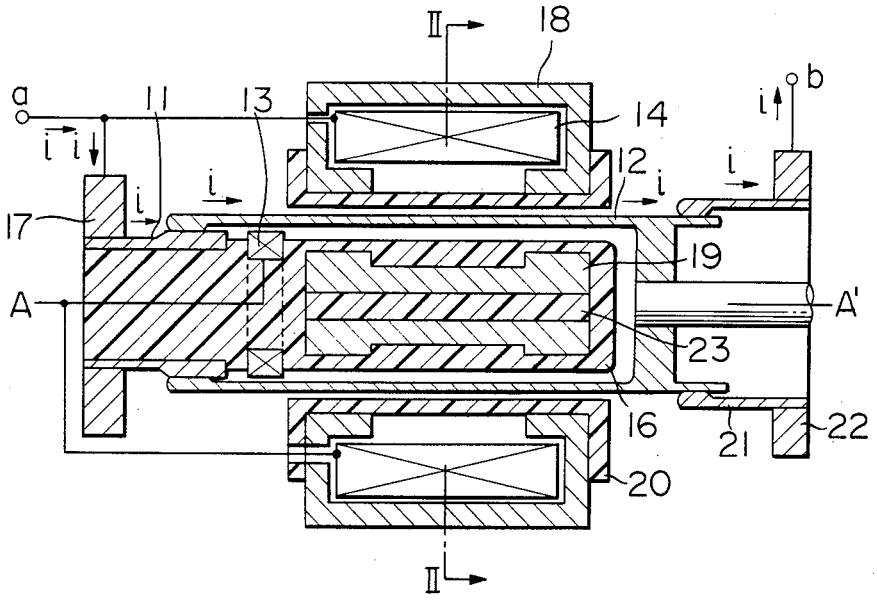
FIG. 5 is a longitudinal cross-sectional view of a spiral arc circuit breaker according to the present invention, showing the state when the circuit breaker is closed.
Figure 6:
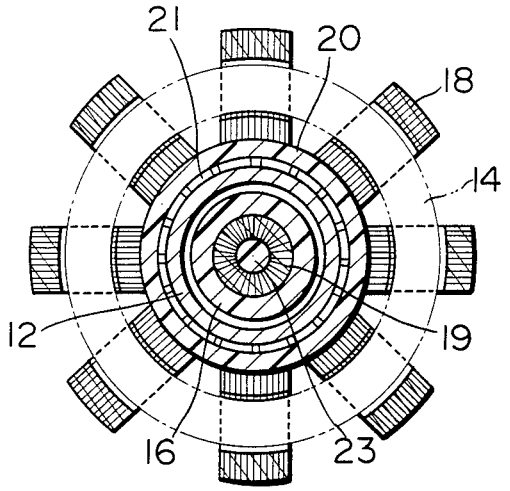
FIG. 6 is a transverse cross-sectional view of the circuit breaker of FIG. 5 taken along line II—II of FIG. 5.
Figure 7:
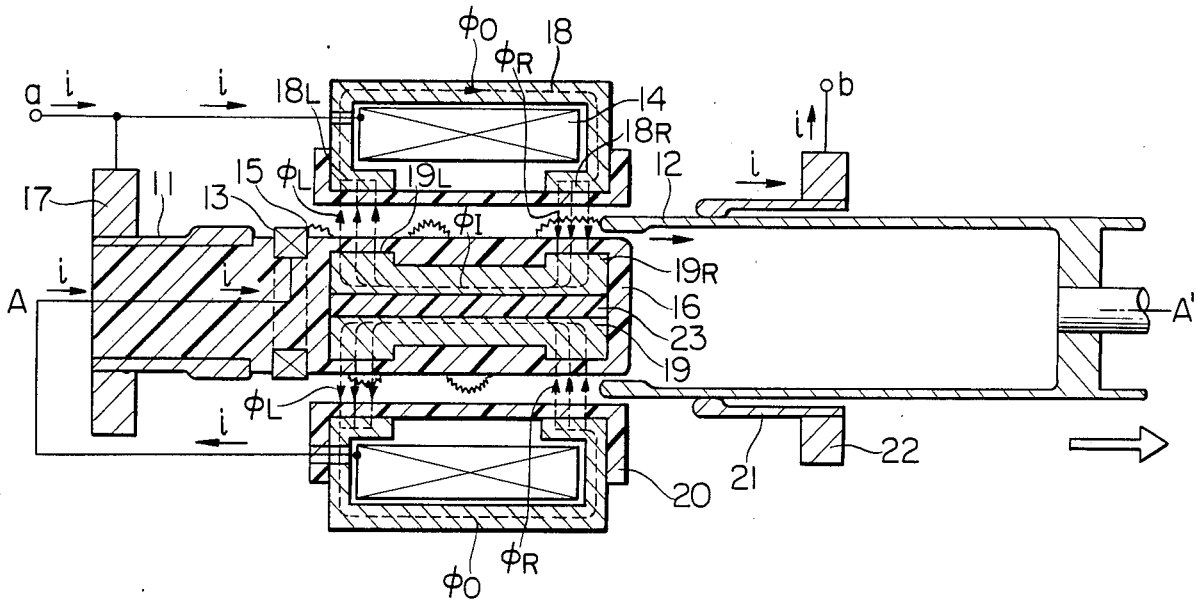
FIG. 7 is a longitudinal cross-sectional view of the circuit breaker of FIG. 5, showing the state when the circuit breaker is first opened.

Now, one embodiment of a spiral arc circuit breaker according to the present invention will be described while making reference to FIGS. 5 through 7 of the attached drawings.

In the figures, element number 11 is a hollow, cylindrical fixed electrode located on the source side of the circuit breaker. Element number 12 is cylindrical movable electrode which is coaxially disposed with respect to the source side fixed electrode 11 along the longitudinal axis A—A′ of the circuit breaker. The movable electrode 12 can be moved longitudinally into and out of contact with the fixed electrode 11. Element number 16 is a rod-shaped inner electrically insulating member housed inside the electrodes 11 and 12. In the present embodiment, the inner insulating member 16 has a circular transverse cross section, but its cross-sectional shape is not limited to being circular and can be elliptical or polygonal. The inner insulating member 16 is made of an electrically insulating material such as polytetrafluoroethylene (known under the trade name of "Teflon"). One end of the inner insulating member 16 is secured to the inner circumference of the fixed electrode 11, which in turn is secured to a source side terminal board 17. The opposite end of the inner insulating member 16 extends into the hollow interior of the movable electrode 12.

Element number 13 is an annular arc runner concentrically secured to the central portion of the inner electrically insulating member 16. A longitudinal separation is left between the arc runner 13 and the fixed electrode 11. Element number 14 is a magnetic drive coil concentrically disposed outside and radially spaced from the movable electrode 12.

Reference number 18 indicates a plurality of first yokes equally spaced along the circumference of the magnetic drive coil 14. As shown in FIG. 5, each of the first yokes 18 has a generally C-shaped longitudinal cross section with the open portion of the C facing inwards towards the inner electrically insulating member 16. The magnetic drive coil 14 passes through the hollow center of each of the first yokes 18 so that each of the first yokes 18 surrounds the outer circumferential surface and lateral sides of a portion of the magnetic drive coil 14 and partially surrounds the inner circumferential surface of the same portion of the magnetic drive coil 14. Element number 19 is a hollow, cylindrical second yoke embedded in that end of the inner insulating member 16 which extends into the movable electrode 12. In the present embodiment, both the first yokes 18 and the second yoke 19 are formed from radially-extending laminated plates of silicon steel or a similar magnetic material. Alternatively, instead of being laminated, either the first yokes 18 or the second yoke 19 or both can be castings of cast iron or other magnetic material.

Element number 20 is a hollow, cylindrical outer electrically insulating member concentrically disposed about the inner electrically insulating member 16. The outer electrically insulating member 20 is radially spaced apart from the inner electrically insulating member 16 so that a longitudinally-extending annular gap is formed therebetween, the gap being large enough to permit the movable electrode 12 to pass through the gap without contacting either of the electrically insulating members 16 and 20. The insulating member 20 serves to protect the magnetic coil 14 and the first yokes 18 from the effects of arcing, and like the inner insulating member 16 is made of an electrically insulating material such as polytetrafluorethylene. Element number 21 is a fixed electrode on the load side of the apparatus in sliding contact with the movable electrode 12, and element number 22 is a terminal board on the load side of the circuit breaker to which the load side fixed electrode 21 is attached. Element number 23 is a longitudinally-extending electrically insulating member made of polytetrafluoroethylene or the like which fills the hollow center of the second yoke 19.

The operation of the embodiment described above will now be explained with reference to FIGS. 5 and 7 through 9. When the circuit breaker is in the closed state shown in FIG. 5, current i flows from the source side a of the circuit breaker through the source side terminal board 17, the source side fixed electrode 11, the movable electrode 12, the load side fixed electrode 21, the load side terminal board 22, and out to the load side b of the circuit breaker. When a command is given for the circuit breaker to open, the movable electrode 12 is moved to the right in the direction of the large arrow by conventional means (not shown) and the movable electrode 12 is separated from the source side fixed electrode 11, as illustrated in FIG. 7.

When the movable electrode 12 first separates from the source side fixed electrode 11, an arc 15 is formed between the two. As the movable electrode 12 is moved farther to the right and the separation between electrodes 11 and 12 increases, the left end of the arc 15 transfers from the source side fixed electrode 11 to the arc runner 13, and current i flows from the source side a through the magnetic drive coil 14, through the arc runner 13, and to the movable electrode 12 via the arc 15, continuing through the load side fixed electrode 21 and the load side terminal board 22 to the load side b. The current i flowing through the magnetic drive coil 14 causes the formation of closed magnetic loops which connect the first yokes 18 and the second yoke 19. Due to the direction of current flow through the magnetic drive coil 14, the direction of the magnetic flux phi in the closed magnetic loops is from left to right in the first yokes 18 and from right to left in the second yoke 19, as shown by the arrows in FIG. 7. Each of the closed magnetic loops can be divided into four different fluxes: $phi_R$, which is the flux from the right end of each of the first yokes 18 to the right end of the second yoke 19; $phi_I$, which is the flux inside the second yoke 19 from its right end to its left end; $phi_L$, which is the flux from the left end of the second yoke 19 to the right end of the first yokes 18; and $phi_O$, which is the flux in the outer portion of each first yoke 18 from its left end to its right end. The flux flowing through the yokes 18 and 19 forms magnetic poles in the yokes 18 and 19: 18R and 18L at the right and left ends, respectively, of each of the first yokes 18, and 19R and 19L at the right and left end, respectively, of the second yoke 19. The directions of the fluxes $phi_R$ and $phi_L$ are perpendicular to the longitudinal axis A—A' of the circuit breaker.

Figure 8:
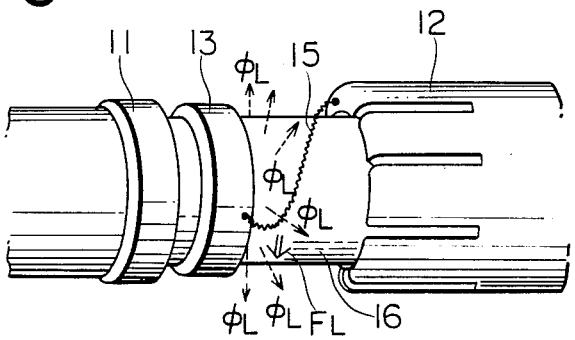
FIG. 8 is a perspective view of the inner members of the circuit breaker of FIG. 5, showing the state when the separation between the electrodes of the circuit breaker is small.
Figure 9:
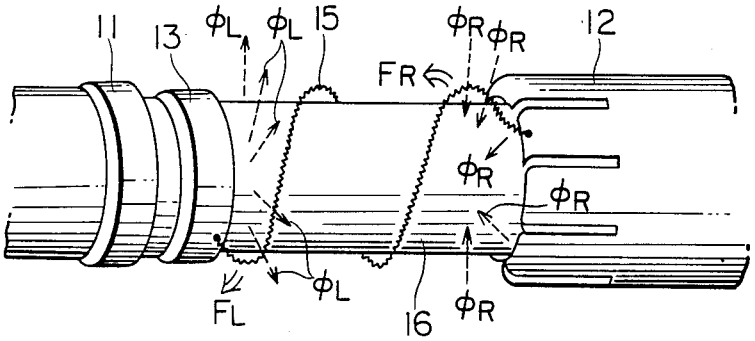
FIG. 9 is another perspective view of the inner members of the circuit breaker of FIG. 5, showing the state when the separation between the electrodes of the circuit breaker is large.

At the state shown in FIG. 8 when there is a small separation between the movable electrode 12 and the arc runner 13, the magnetic flux $phi_L$ and the arc 15, which extends parallel to axis A—A' between the arc runner 13 and the movable electrode 12, intersect at right angles, and a force $F_L$ acts on the arc 15 in the clockwise circumferential direction (as viewed from the left end of FIG. 8) in accordance with Fleming's left-hand rule. This force $F_L$ causes the arc 15 to rotate around the outside of the cylindrical inner insulating member 16. At this point, the behavior of the arc 15 is identical to that in a conventional rotary arc circuit breaker. However, as the distance between the electrodes 11 and 12 further increases to the state shown in FIG. 9, the portion of the arc 15 in the vicinity of the movable electrode 12 crosses the flux $phi_R$, and a force $F_R$ acts on this portion of the arc in the counterclockwise direction (as viewed from the left end of FIG. 9), in the direction opposite to the force $F_L$. Accordingly, the portion of the arc 15 in the vicinity of the movable electrode 12 rotates in the direction opposite to the portion of the arc 15 in the vicinity of the source side fixed electrode 11. The arc 15 is caused to spiral about the outside of the inner insulating member 16, and its behavior becomes like that of an arc in a conventional spiral arc circuit breaker.

The arc 15 is extinguished at a current zero by a combination of the cooling effect produced by the relative motion between the spiraling arc 15 and a stationary arc-extinguishing medium (such as $SF_6$ gas) contained in the circuit breaker, and by the increase in length of the arc caused by spiraling, the arc lengthening until the system voltage cannot maintain the arc any longer.

The special characteristics of the present invention are as follows.

(1) The first yokes 18 are disposed on the outside of the magnetic loops formed by the magnetic drive coil 14, and the second yoke 19 is disposed inside the magnetic loops, and a gap through which the movable electrode 12 and the arc 15 passes is formed therebetween. Magnetic poles 18L and 18R are formed in the first yokes 18, and magnetic poles 19R and 19L are formed in the second yoke 19. Accordingly, with only a small magnetomotive force (=current×number of coil turns), a large magnetic flux can be formed in the gap. This magnetic flux is perpendicular to the longitudinal axis A—A' of the circuit breaker, and so an effective rotational driving force can be applied to the arc 15.

(2) Since the direction of the magnetic fluxes $phi_R$ and $phi_L$ in the gap at its right and left ends, respectively, are perpendicular to the longitudinal axis A—A' of the circuit breaker, force can be effectively applied to the arc 15 even though the arc 15 extends parallel to the longitudinal axis A—A'. Thus, it is not necessary for the movable electrode 12 to have an E-shaped cross section as in the conventional spiral arc circuit breaker shown in FIG. 2 but can have the simple cylindrical shape shown in FIG. 5.

Figure 4:
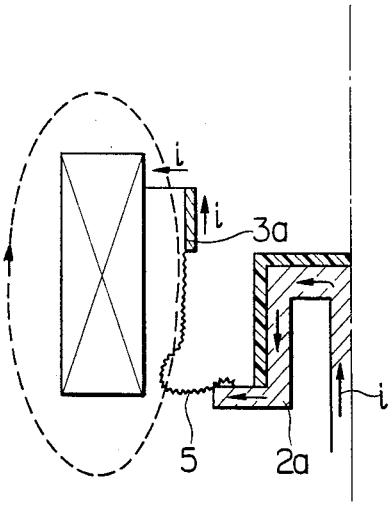
FIG. 4 PRIOR ART
FIG. 4 is view of the same portion illustrated in FIG. 3, showing the shape of an arc when the electrode separation is large.

(3) Unlike the conventional spiral arc circuit breaker shown in FIG. 4, the electromotive force acting on the arc 15 in the vicinity of the arc runner does not decrease as the separation between electrodes increases.

Figure 1:
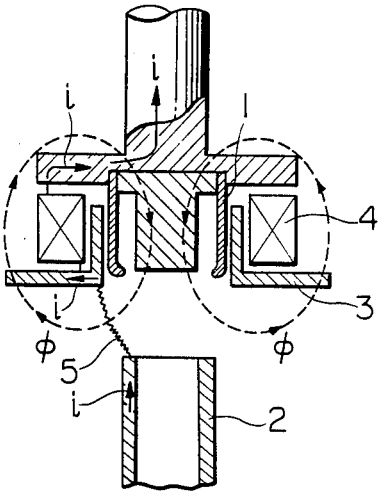
FIG. 1 PRIOR ART
FIG. 1 is a longitudinal cross-sectional view of a conventional rotary arc circuit breaker.
Figure 2:
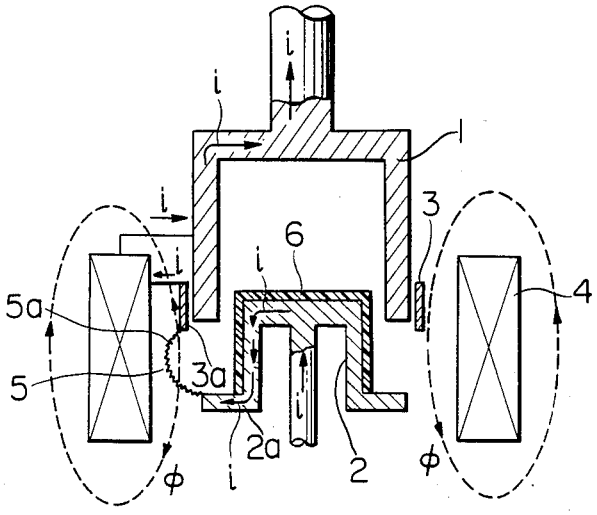
FIG. 2 PRIOR ART
FIG. 2 is a longitudinal cross-sectional view of a conventional spiral arc circuit breaker.
Figure 3:
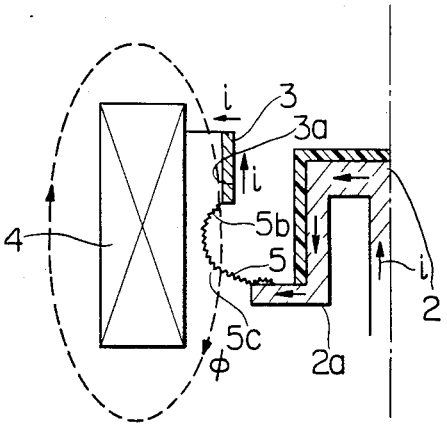
FIG. 3 PRIOR ART
FIG. 3 is a longitudinal cross-sectional view of a portion of the circuit breaker of FIG. 2, showing the shape of an arc when the electrode separation is small.

(4) In the conventional circuit breakers illustrated in FIGS. 1 and 2, the magnetic flux acting on the arc decreases as the electrode separation increases. However, in the present invention, the magnetic resistance of the yokes 18 and 19 can be neglected, and the strength of the flux which intersects the arc 15 is independent of the separation between electrodes 11 and 12. It is thus possible to create a long spiral arc 15, which because of its length also has a large electrical resistance, and it is therefore possible to carry out larger current limitation and carry out breaking at a current zero.

Finally, a circuit breaker according to the present invention is appropriate for handling high-voltage direct current as well as alternating current.

What is claimed is:

1. A spiral arc circuit breaker comprising:

a hollow fixed electrode which is electrically connected to the source side of said circuit breaker;

a hollow movable electrode which is electrically connected to the load side of said circuit breaker and which is coaxially disposed with respect to said fixed electrode and which is slidably mounted so as to be capable of sliding axially from a first position in which it is in contact with said fixed electrode to a second position spaced axially from said first position and in which it is separated by an arc forming space from said fixed electrode;

a longitudinally extending inner electrically insulating member coaxially disposed with respect to said fixed electrode, one end of which is secured to said fixed electrode and the other end of which extends into the interior of said space, the outer surface of said inner electrically insulating member being radially spaced from the inner surface of said movable electrode when said movable electrode is in said first position;

a hollow, longitudinally extending outer electrically insulating member which is coaxially disposed with respect to said inner electrically insulating member and which is radially spaced therefrom so that a longitudinally extending annular gap is formed therebetween at said arc forming space through which said movable electrode can pass; and a magnetic flux forming means extending axially along said arc forming space on the inside and outside of said space, said flux forming means being capable of forming a flux extending radially inwards at one of the longitudinal ends of said arc forming space and radially outwards at the opposite longitudinal end of said arc forming space.

2. A spiral arc circuit breaker as claimed in claim 1, wherein said means for producing a magnetic flux comprises:

a magnetic drive coil coaxially disposed around said outer electrically-insulating member;

a plurality of first yokes disposed at intervals along the circumference of said drive coil, each of said first yokes having a hollow center through which said drive coil passes and being shaped so as to completely surround the outer circumferential surface and the lateral sides of a portion of said drive coil and to partially surround the inner circumferential surface of said portion of said drive coil; and a longitudinally-extending second yoke embedded inside said other end of said inner electrically insulating member and coaxially disposed with respect to said inner electrically insulating member.

3. A spiral arc circuit breaker as claimed in claim 1, wherein said inner electrically-insulating member has a circular transverse cross-sectional shape.

4. A spiral arc circuit breaker as claimed in claim 1, wherein said inner electrically insulating member has a polygonal transverse cross-sectional shape.

5. A spiral arc circuit breaker as claimed in claim 2, wherein said first yokes and said second yoke comprise radially-extending laminated plates of a magnetic material.

6. A spiral arc circuit breaker as claimed in claim 2, wherein said first yokes and said second yoke comprises a casting of a magnetic material.

7. A spiral arc circuit breaker as claimed in claim 2, wherein said first yokes comprise radially-extending laminated plates of a magnetic material and said second yoke comprises a casting of a magnetic material.

8. A spiral arc circuit breaker as claimed in claim 2, wherein said first yokes comprise a casting of a magnetic material and said second yoke comprises radially-extending laminated plates of a magnetic material.

9. A spiral arc circuit breaker as claimed in claim 2, wherein said second yoke has a hollow center.

* * * * *